US011842635B2

(12) United States Patent
Wohler

(10) Patent No.: US 11,842,635 B2
(45) Date of Patent: Dec. 12, 2023

(54) TRAFFIC LIGHT CONTROL ASSEMBLY

(71) Applicant: Richard Wohler, Sheboygan, WI (US)

(72) Inventor: Richard Wohler, Sheboygan, WI (US)

( * ) Notice: Subject to any disclaimer, the term of this patent is extended or adjusted under 35 U.S.C. 154(b) by 167 days.

(21) Appl. No.: 17/508,407

(22) Filed: Oct. 22, 2021

(65) Prior Publication Data

US 2023/0130870 A1 Apr. 27, 2023

(51) Int. Cl.

| | |
|---|---|
| ***G08G 1/08*** | (2006.01) |
| ***G08G 1/082*** | (2006.01) |
| ***G08G 1/042*** | (2006.01) |
| ***G08G 1/01*** | (2006.01) |

(52) U.S. Cl.

CPC ..... *G08G 1/082* (2013.01); *G08G 1/0125* (2013.01); *G08G 1/042* (2013.01); *G08G 1/08* (2013.01)

(58) Field of Classification Search

CPC ..... G08G 1/082; G08G 1/0125; G08G 1/042; G08G 1/08; G08G 1/04; G08G 1/095

See application file for complete search history.

(56) References Cited

U.S. PATENT DOCUMENTS

| | | | | |
|---|---|---|---|---|
| D430,054 | S | 8/2000 | McMullen | |
| 6,970,102 | B2 | 11/2005 | Ciolli | |
| 7,616,293 | B2 | 11/2009 | Sirota | |
| 7,689,347 | B2 | 3/2010 | Wall, III | |
| 7,821,422 | B2 | 10/2010 | Hutchison | |
| 8,819,313 | B1 | 8/2014 | Walther | |
| 9,235,988 | B2 | 1/2016 | Mimeault | |
| 10,600,319 | B1 * | 3/2020 | Shuff | G08G 1/0116 |
| 2011/0205086 | A1 * | 8/2011 | Lamprecht | G08G 1/08 340/928 |
| 2014/0159925 | A1 * | 6/2014 | Mimeault | G01S 17/58 340/935 |
| 2017/0372602 | A1 | 12/2017 | Gilliland | |
| 2019/0120650 | A1 * | 4/2019 | Miyake | H04N 7/18 |

FOREIGN PATENT DOCUMENTS

| | | |
|---|---|---|
| WO | WO2013128427 | 9/2013 |

* cited by examiner

*Primary Examiner* — Mohamed Barakat
*Assistant Examiner* — Sharmin Akhter

(57) ABSTRACT

A traffic light control assembly includes a plurality of mounting poles each attached to a cross beam of a respective traffic signal at a roadway intersection. A plurality of light detection and ranging sensors is each mounted to a respective mounting pole to be elevated over traffic on the roadway. Each of the light detection and ranging sensors is positioned to sense the number of vehicles that are stopped at an opposing traffic signal. Each of the light detection and ranging sensors is in electrical communication with a remote data unit thereby facilitating the remote data unit to analyze data gathered by each of the light detection and ranging sensors with respect to the number of vehicles. Moreover, the remote data unit adjusts timing of the traffic signals to most efficiently direct traffic through the intersection with respect to the number of vehicles that are approaching the intersection.

5 Claims, 6 Drawing Sheets

TRAFFIC LIGHT CONTROL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to traffic control devices and more particularly pertains to a new traffic control device for adjusting timing of traffic controls based on real time traffic patterns. The device includes a plurality of light detection and ranging sensors that is each mounted to a respective traffic signal at a roadway intersection. Each of the light detection and ranging sensors senses the traffic at each of respective traffic signal. Additionally, each of the light detection and ranging sensors is in communication with the traffic signals for adjusting the timing of the traffic signals to most efficiently direct traffic through the roadway intersection.

(2) Description of Related Art Including Information Disclosed Under 37 CFR 1.97 and 1.98

The prior art relates to traffic control devices including a variety of traffic control devices the employ a radar system to identify traffic passing through a roadway intersection for enforcing traffic laws. The prior art discloses a variety of traffic control devices that employ a radar system that is in communication with traffic lights at a roadway intersection for adjusting timing of the traffic lights in correspondence with traffic patterns. The prior art discloses a variety of traffic control devices that employ digital cameras that are in communication with traffic lights at a roadway intersection for adjusting timing of the traffic lights in accordance with traffic patterns. The prior art discloses a traffic control device that employs a three dimensional optical emitter and a two dimensional optical emitter for controlling timing of traffic lights at a roadway intersection. The prior art discloses a traffic control device that includes light detection and ranging sensors and cameras to monitor and control traffic at a roadway intersection.

BRIEF SUMMARY OF THE INVENTION

An embodiment of the disclosure meets the needs presented above by generally comprising a plurality of mounting poles each attached to a cross beam of a respective traffic signal at a roadway intersection. A plurality of light detection and ranging sensors is each mounted to a respective mounting pole to be elevated over traffic on the roadway. Each of the light detection and ranging sensors is positioned to sense the number of vehicles that are stopped at an opposing traffic signal. Each of the light detection and ranging sensors is in electrical communication with a remote data unit thereby facilitating the remote data unit to analyze data gathered by each of the light detection and ranging sensors with respect to the number of vehicles. Moreover, the remote data unit adjusts timing of the traffic signals to most efficiently direct traffic through the intersection with respect to the number of vehicles that are approaching the intersection.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
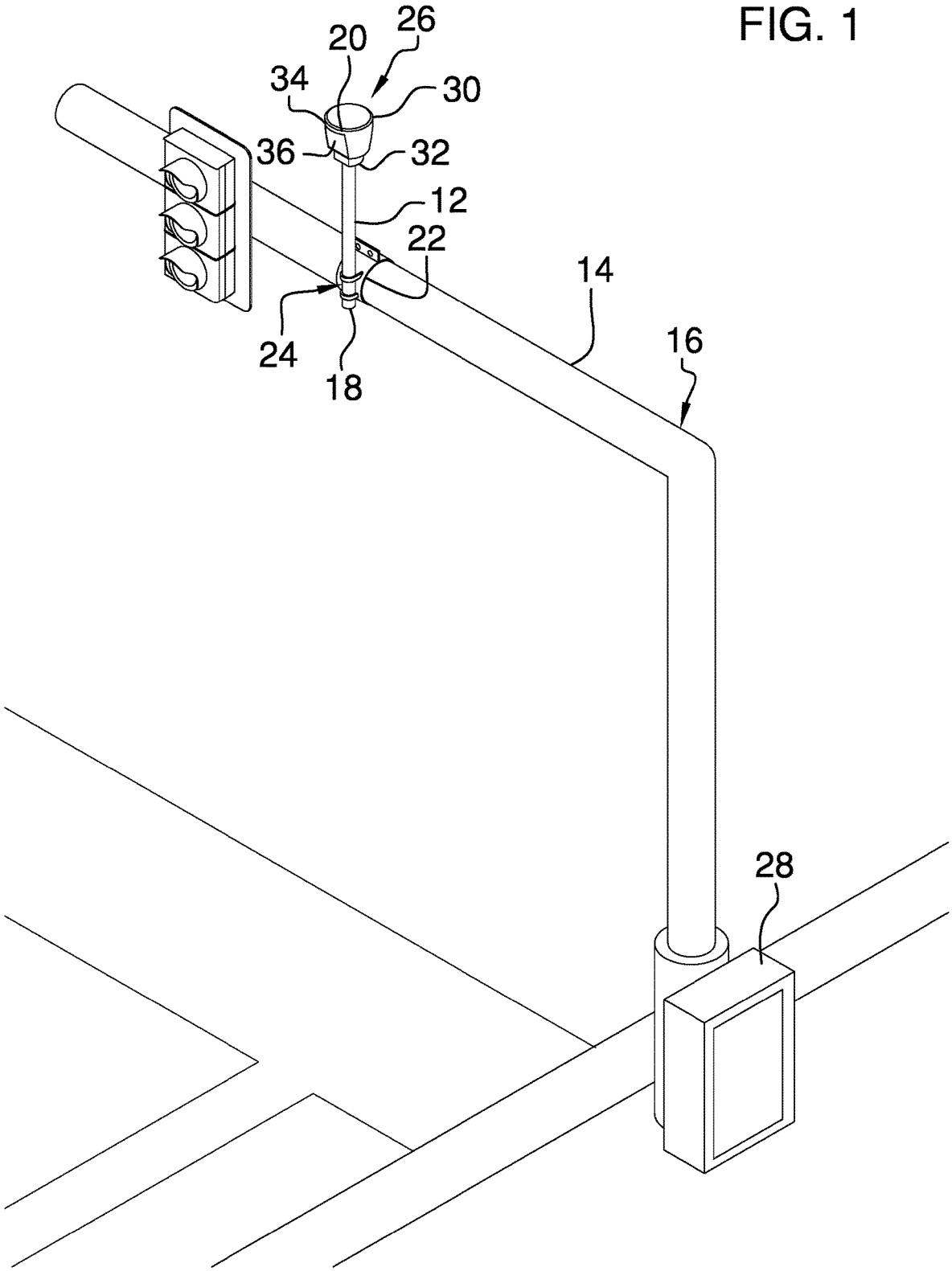
FIG. 1 is a perspective view of a traffic light control assembly according to an embodiment of the disclosure.
Figure 2:
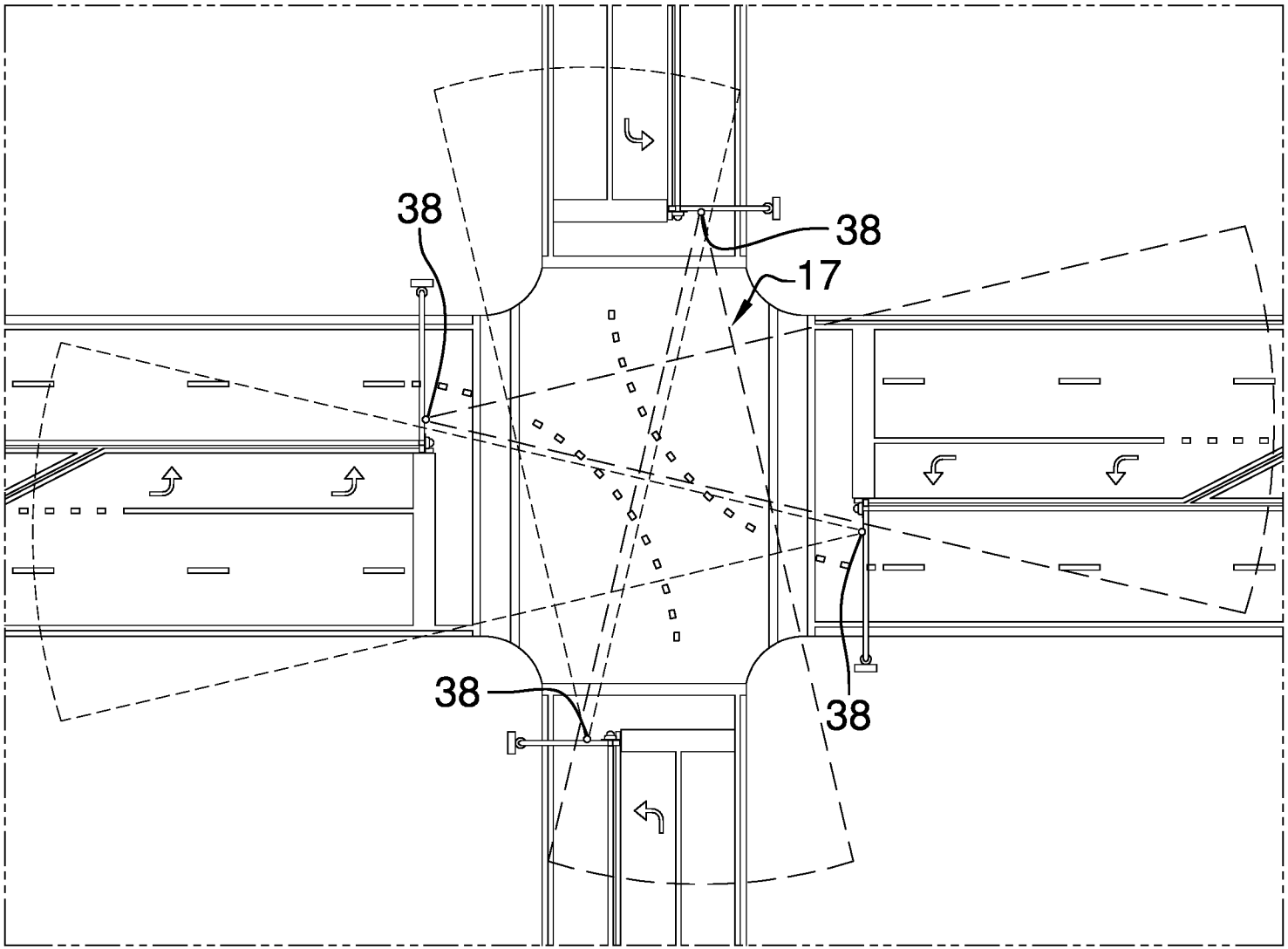
FIG. 2 is a top perspective in-use view of an embodiment of the disclosure showing front view light detection and ranging sensors scanning a roadway intersection.
Figure 3:
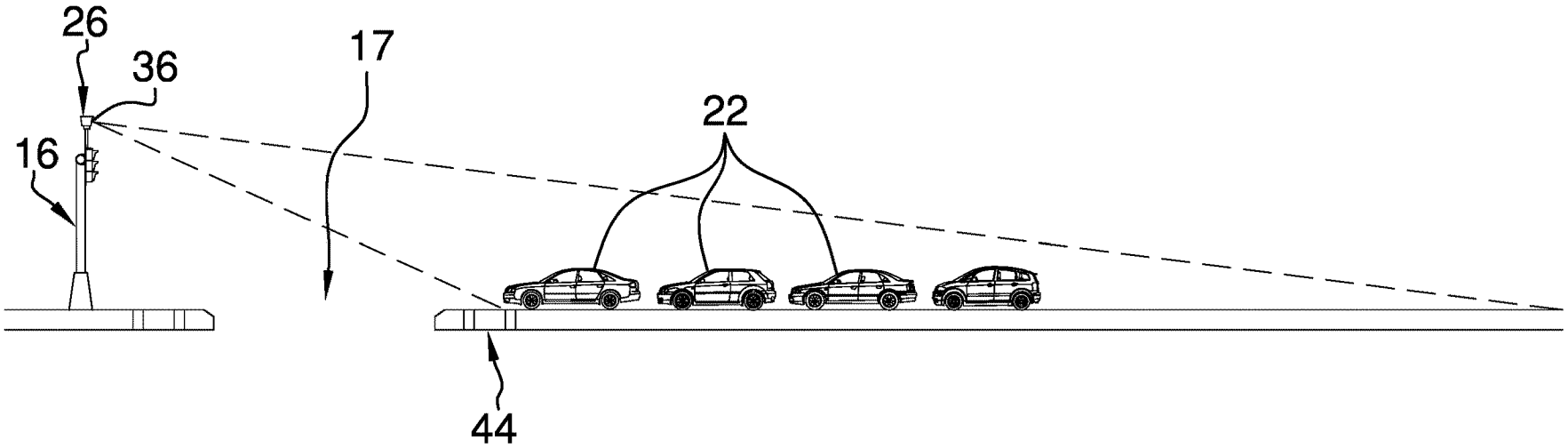
FIG. 3 is a left side in-use view of an embodiment of the disclosure showing front view light detection and ranging sensors scanning a roadway intersection.
Figure 4:
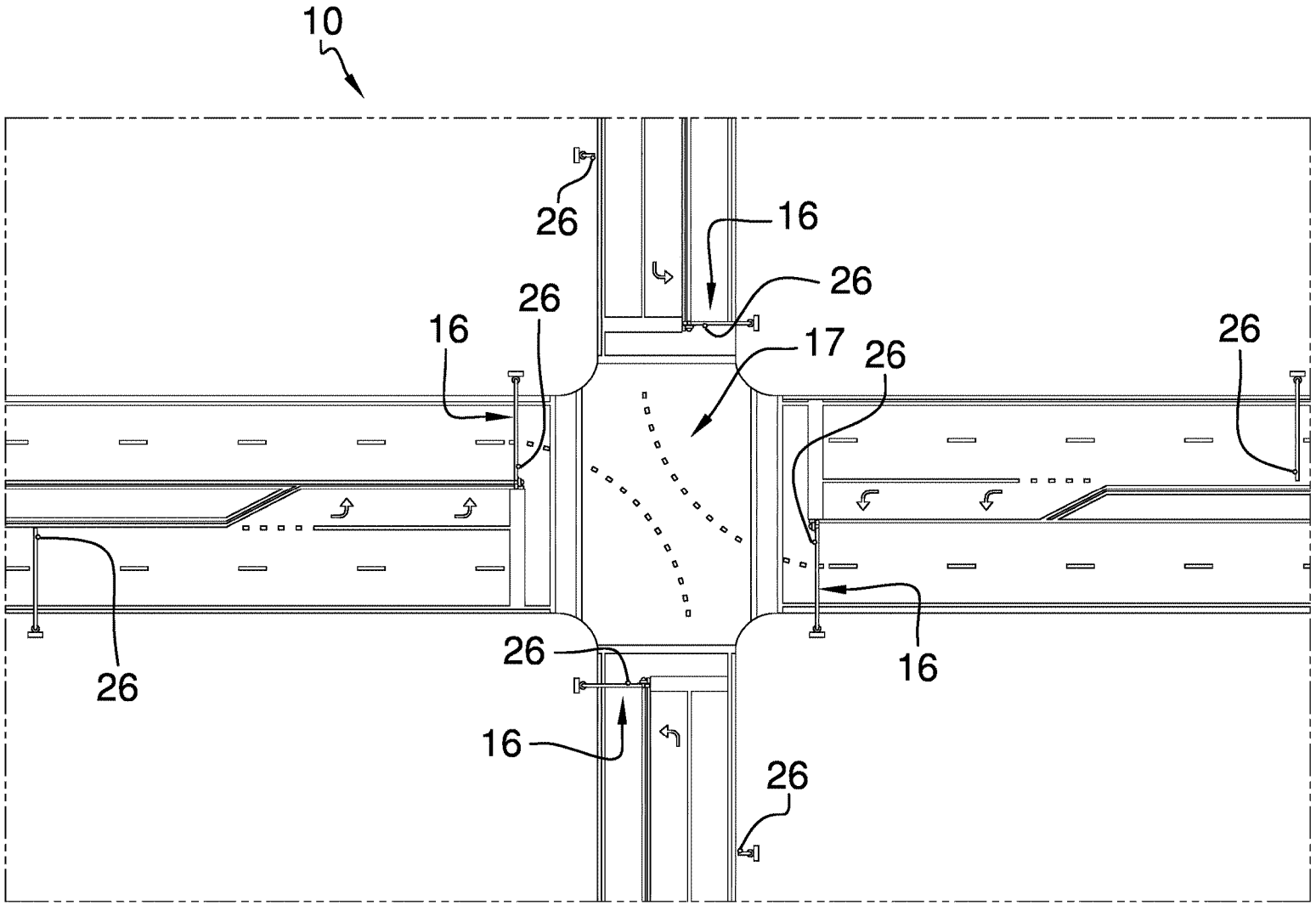
FIG. 4 is a top perspective view of an embodiment of the disclosure.

With reference now to the drawings, and in particular to FIGS. 1 through 6 thereof, a new traffic control device embodying the principles and concepts of an embodiment of the disclosure and generally designated by the reference numeral 10 will be described.

As best illustrated in FIGS. 1 through 6, the traffic light control assembly 10 generally comprises a plurality of mounting poles 12 that is each attached to a cross beam 14 of a respective traffic signal 16 at a roadway intersection 17. Each of the mounting poles 12 is vertically oriented on the cross beam 14 of the respective traffic signal 16 and each of the mounting poles 12 has a lower end 18 and an upper end 20. A plurality of collars 22 is each positioned around the cross beam 14 of a respective one of the traffic signals 16. A respective one of the mounting poles 12 is attached to each of the collars 22 at an attachment point 24 located adjacent to the lower end 18 of the respective mounting pole 12. The roadway intersection 17 may be a four way roadway intersection located in a city or a rural location.

A plurality of light detection and ranging sensors 26 is provided and each of the light detection and ranging sensors 26 is mounted to a respective one of the mounting poles 12. In this way each of the light detection and ranging sensors 26 can be elevated over traffic in the roadway intersection 17. Each of the light detection and ranging sensors 26 is directed to face across the roadway intersection 17. In this way each of the light detection and ranging sensors 26 can direct a laser beam across the roadway intersection 17 thereby sensing the number of vehicles 27 that are stopped at an opposing traffic signal 16.

Each of the light detection and ranging sensors 26 is in electrical communication with a remote data unit 28 thereby facilitating the remote data unit 28 to analyze data gathered by each of the light detection and ranging sensors 26 with respect to the number of vehicles 27. Furthermore, the remote data unit 28 is in electrical communication with each of the traffic signals 16. In this way the remote data unit 28 can adjust timing of the traffic signals 16 to most efficiently direct traffic through the roadway intersection 17 with respect to the number of vehicles 27 that are approaching the roadway intersection 17.

Each of the light detection and ranging sensors 26 comprises a housing 30 that has a bottom side 32 and a forward side 34. The bottom side 32 of each housing 30 is coupled to the upper end 20 of a respective one of the mounting poles 12. The housing 30 is oriented such that the forward side 34 is directed toward an opposing traffic signal 16 with respect to the traffic signal 16 upon which the housing 30 is mounted. Each of the light detection and ranging sensors 26 includes an emitter 36 that is integrated into the forward side 34 of the housing 30 to emit a laser beam across the roadway intersection 17 toward the opposing traffic signal 16. Additionally, the emitter 36 has a 20.0 percent vertical field of view and the emitter 36 is electrically coupled to the remote data unit 28.

The plurality of light detection and ranging sensors 26 includes a set of front view light detection and ranging sensors 38 and a set of rear view light detection and ranging sensors 40. As is most clearly shown in FIGS. 2 and 3, each of the front view light detection and ranging sensors 38 is positioned on the cross beam 14 of the respective traffic signal 16. In this way each of the front view light detection and ranging sensors 38 can sense a front side 42 of vehicles 27 at the roadway intersection 17. Moreover, the emitter 36 associated with each of the front view light detection and ranging sensors 38 is oriented at a strategic downward angle. In this way the emitter 36 associated with each of the front view light detection and ranging sensors 38 can scan traffic at the opposing traffic signal 16 beginning from a cross walk 44 aligned with the opposing traffic signal 16 toward a direction of traffic flow of the vehicles 27 approaching the opposing traffic signal 16. Thus, the emitter 36 associated with each of the front view light detection and ranging sensors 38 can sense each vehicle 27 that is stopped at the opposing traffic signal 16 or each vehicle 27 that is approaching the opposing traffic signal 16.

Figure 5:
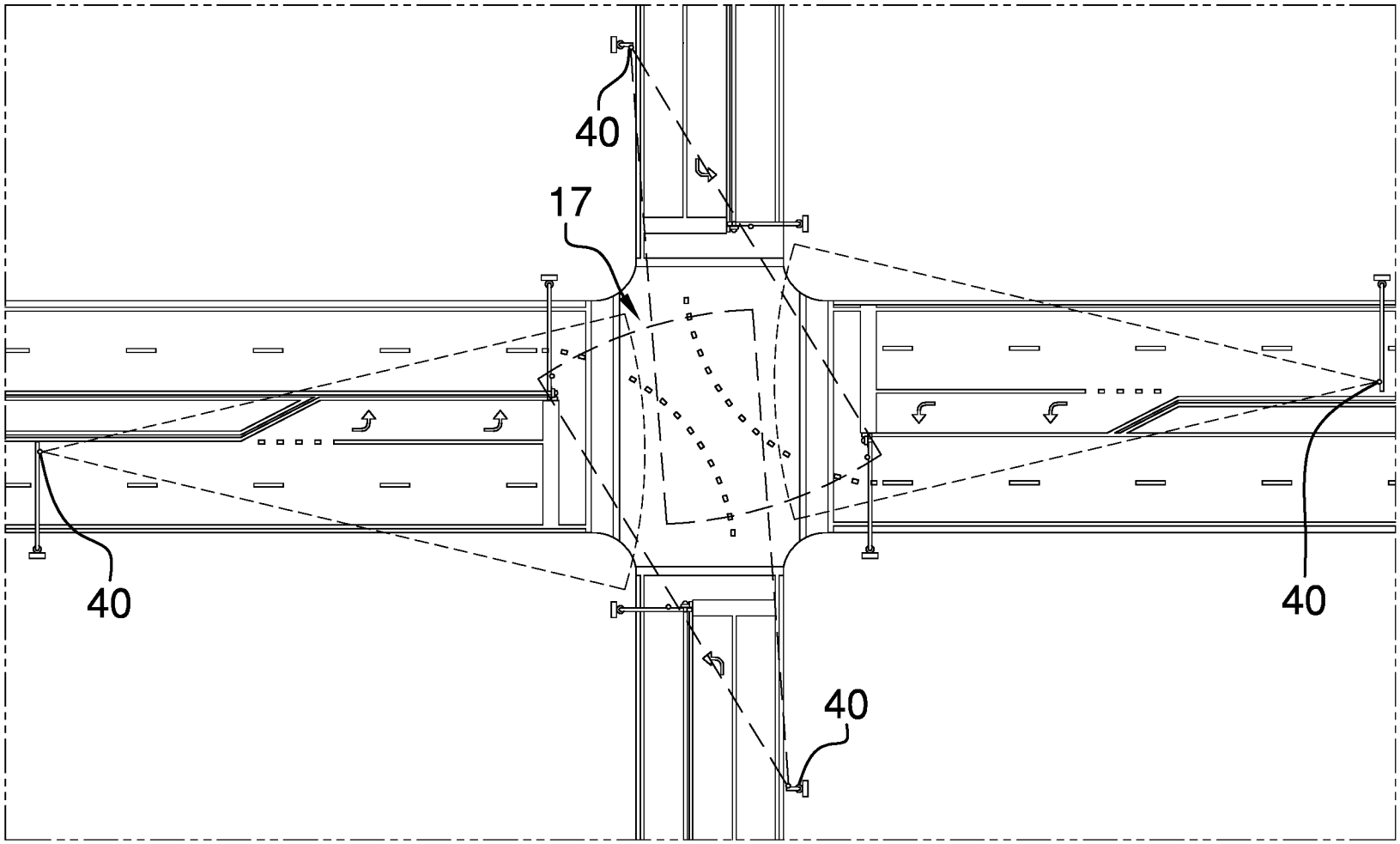
FIG. 5 is a top perspective in-use view of an embodiment of the disclosure showing rear view light detection and ranging sensors scanning a roadway intersection.
Figure 6:
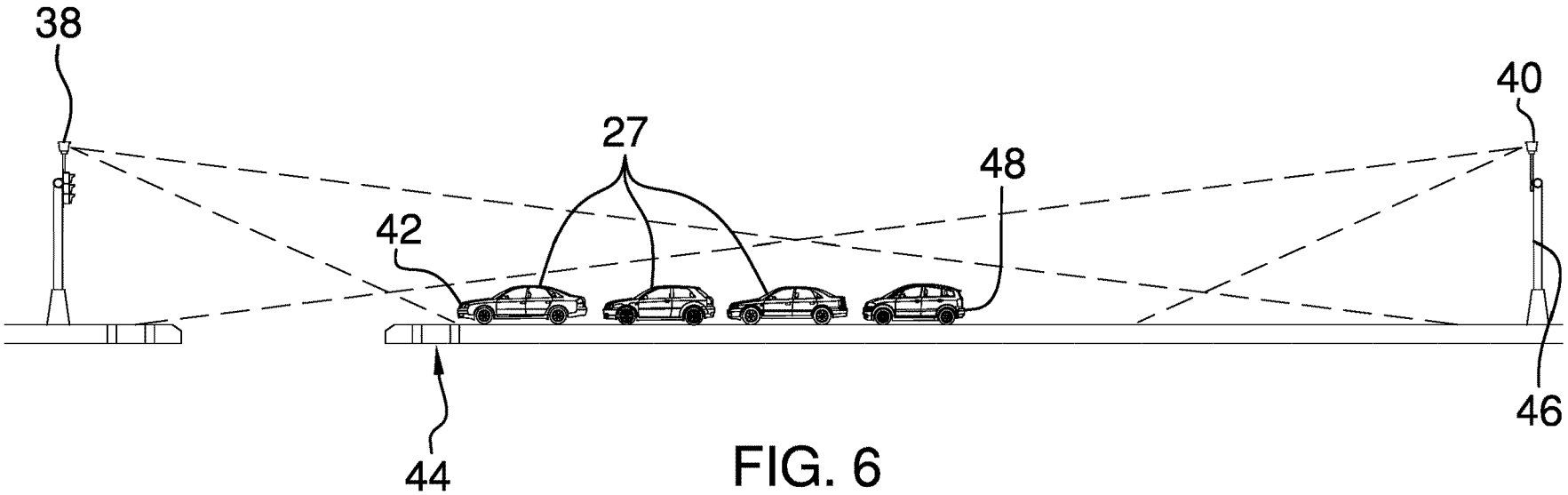
FIG. 6 is a left side in-use view of an embodiment of the disclosure showing rear view light detection and ranging sensors scanning a roadway intersection.

As is most clearly shown in FIGS. 5 and 6, each of the rear view light detection and ranging sensors 40 is positioned on a stanchion 46 which is located adjacent to a respective roadway associated with the roadway intersection 17. Each of the rear view light detection and ranging sensors 40 is positioned downstream from a respective one of the traffic signals 16 with respect to the flow of traffic associated with the respective traffic signal 16. Furthermore, the emitter 36 on each of the rear view light detection and ranging sensors 40 is directed toward the respective traffic signal 16. In this way each of the rear view light detection and ranging sensors 40 can sense the rear side 48 of the vehicles 27 at the roadway intersection 17.

In use, each of the front view light detection and ranging sensors 38 senses the front side 42 of the vehicles 27 that are either stopped at the opposing traffic signal 16 or vehicles 27 that are approaching the opposing traffic signal 16. Each of the rear view light detection and ranging sensors 40 senses the rear side 48 of the vehicles 27 that are either stopped at the traffic signal 16 or that are approaching the traffic signal 16. The remote data unit 28 analyzes the data collected from each of the front view light detection and ranging sensors 38 and each of the rear view light detection and ranging sensors 40. Additionally, the remote data unit 28 adjusts the timing and sequencing of the traffic signals 16 to most efficiently manage the traffic at the roadway intersection 17. In this way the roadway intersection 17 can efficiently handle light traffic or heavy traffic without employing pre-determined timing and sequencing as is the common practice with existing traffic signals. Thus, the traffic signals 16 can be operated with a variety of timings and sequences, determined in real time based upon the rate of traffic passing through the roadway intersection 17.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A traffic light control assembly for monitoring traffic patterns at an intersection and adjusting timing of traffic lights at the intersection to match the traffic patterns, said assembly comprising:

a plurality of mounting poles, each of said mounting poles being attached to a cross beam of a respective traffic signal at a roadway intersection;

a plurality of light detection and ranging sensors, each of said light detection and ranging sensors being mounted to a respective one of said mounting poles wherein each of said light detection and ranging sensors is configured to be elevated over traffic on the roadway, each of said light detection and ranging sensors being directed to face across the intersection wherein each of said light detection and ranging sensors is configured to direct a laser beam across the intersection thereby sensing the number of vehicles that are stopped at an opposing traffic signal, each of said light detection and ranging sensors being in electrical communication with a remote data processor thereby facilitating said remote data processor to analyze data gathered by each of said light detection and ranging sensors with respect to the number of vehicles, said remote data processor being in electrical communication with each of the traffic signals wherein said remote data processor is configured to adjust timing of the traffic signals to most efficiently direct traffic through the intersection with respect to the number of vehicles that are approaching the intersection;

wherein each of said mounting poles is vertically oriented on the cross beam of the respective traffic signal, each of said mounting poles having a lower end and an upper end;

wherein said assembly includes a plurality of collars, each of said collars being positioned around the cross beam of a respective one of the traffic signals, a respective one of said mounting poles being attached to each of said collars at an attachment point located adjacent to said lower end of said respective mounting pole; and wherein each of said light detection and ranging sensor comprises a housing having a bottom side and a forward side, said bottom side being coupled to said upper end of a respective one of said mounting poles, said housing being oriented such that said forward side is directed toward an opposing traffic signal with respect to the traffic signal upon which said housing is mounted; and an emitter being integrated into said forward side wherein said emitter is configured to emit a laser beam across the intersection toward the opposing traffic signal, said emitter having a 20.0 percent vertical field of view, said emitter being electrically coupled to the remote data processor.

2. The assembly according to claim 1, wherein said plurality of light detection and ranging sensors includes a set of front view light detection and ranging sensors and a set of rear view light detection and ranging sensors, each of said front view light detection and ranging sensors being positioned on the cross member of the respective traffic signal wherein each of said front view light detection and ranging sensors is configured to sense the front side of vehicles on the roadway, an emitter associated with each of said front view light detection and ranging sensors being oriented at a strategic downward angle thereby facilitating said emitter associated with each of said front view light detection and ranging sensors to scan traffic at the opposing traffic signal beginning from a cross walk aligned with the opposing traffic signal toward a direction of traffic flow of the vehicles approaching the opposing traffic signal wherein said emitter associated with each of said front view light detection and ranging sensors is configured to sense each vehicle that is stopped at the opposing traffic signal or each vehicle that is approaching the opposing traffic signal.

3. The assembly according to claim 2, wherein each of said rear view light detection and ranging sensors is positioned on a stanchion being located adjacent to a respective roadway associated with the intersection, each of said rear view light detection and ranging sensors being positioned downstream from a respective one of the traffic signals with respect to the flow of traffic associated with the respective traffic signal, an emitter on each of said rear view light detection and ranging sensors being directed toward the respective traffic signal wherein each of said rear view light detection and ranging sensors is configured to sense the rear side of the vehicles on the roadway.

4. A traffic light control assembly for monitoring traffic patterns at an intersection and adjusting timing of traffic lights at the intersection to match the traffic patterns, said assembly comprising:

a plurality of mounting poles, each of said mounting poles being attached to a cross beam of a respective traffic signal at a roadway intersection, each of said mounting poles being vertically oriented on the cross beam of the respective traffic signal, each of said mounting poles having a lower end and an upper end;

a plurality of collars, each of said collars being positioned around the cross beam of a respective one of the traffic signals, a respective one of said mounting poles being attached to each of said collars at an attachment point located adjacent to said lower end of said respective mounting pole;

a plurality of light detection and ranging sensors, each of said light detection and ranging sensors being mounted to a respective one of said mounting poles wherein each of said light detection and ranging sensor is configured to be elevated over traffic on the roadway, each of said light detection and ranging sensors being directed to face across the intersection wherein each of said light detection and ranging sensors is configured to direct a laser beam across the intersection thereby sensing the number of vehicles that are stopped at an opposing traffic signal, each of said light detection and ranging sensors being in electrical communication with a remote data processor thereby facilitating said remote data processor to process data gathered by each of said light detection and ranging sensors with respect to the number of vehicles, said remote data processor being in electrical communication with each of the traffic signals wherein said remote data processor is configured to adjust timing of the traffic signals to most efficiently direct traffic through the intersection with respect to the number of vehicles that are approaching the intersection, each of said light detection and ranging sensor comprising:

a housing having a bottom side and a forward side, said bottom side being coupled to said upper end of a respective one of said mounting poles, said housing being oriented such that said forward side is directed toward an opposing traffic signal with respect to the traffic signal upon which said housing is mounted; and an emitter being integrated into said forward side wherein said emitter is configured to emit a laser beam across the intersection toward the opposing traffic signal, said emitter having a 20.0 percent vertical field of view, said emitter being electrically coupled to the remote data processor; and wherein said plurality of light detection and ranging sensors includes a set of front view light detection and ranging sensors and a set of rear view light detection and ranging sensors, each of said front view light detection and ranging sensors being positioned on the cross member of the respective traffic signal wherein each of said front view light detection and ranging sensors is configured to sense the front side of vehicles on the roadway, said emitter associated with each of said front view light detection and ranging sensors being oriented at a strategic downward angle thereby facilitating said emitter associated with each of said front view light detection and ranging sensors to scan traffic at the opposing traffic signal beginning from a cross walk aligned with the opposing traffic signal toward a direction of traffic flow of the vehicles approaching the opposing traffic signal wherein said emitter associated with each of said front view light detection and ranging sensors is configured to sense each vehicle that is stopped at the opposing traffic signal or each vehicle that is approaching the opposing traffic signal, each of said rear view light detection and ranging sensors being positioned on a stanchion being located adjacent to a respective roadway associated with the intersection, each of said rear view light detection and ranging sensors being positioned downstream from a respective one of the traffic signals with respect to the flow of traffic associated with the respective traffic signal, said emitter on each of said rear view light detection and ranging sensors being directed toward the respective traffic signal wherein each of said rear view light detection and ranging sensors is configured to sense the rear side of the vehicles on the roadway.

5. A traffic light control system for monitoring traffic patterns at an intersection and adjusting timing of traffic lights at the intersection to match the traffic patterns, said system comprising:

a plurality of traffic signals, each of said traffic signals being positioned at a four way intersection of a roadway, each of said traffic signals including a cross beam;

a plurality of mounting poles, each of said mounting poles being attached to said cross beam of a respective traffic signal at a roadway intersection, each of said mounting poles being vertically oriented on said cross beam of said respective traffic signal, each of said mounting poles having a lower end and an upper end;

a plurality of collars, each of said collars being positioned around said cross beam of a respective one of said traffic signals, a respective one of said mounting poles being attached to each of said collars at an attachment point located adjacent to said lower end of said respective mounting pole;

a plurality of light detection and ranging sensors, each of said light detection and ranging sensors being mounted to a respective one of said mounting poles wherein each of said light detection and ranging sensor is configured to be elevated over traffic on the roadway, each of said light detection and ranging sensors being directed to face across the intersection wherein each of said light detection and ranging sensors is configured to direct a laser beam across the intersection thereby sensing the number of vehicles that are stopped at an opposing traffic signal, each of said light detection and ranging sensors being in electrical communication with a remote data processor thereby facilitating said remote data processor to analyze data gathered by each of said light detection and ranging sensors with respect to the number of vehicles, said remote data processor being in electrical communication with each of said traffic signals, said remote data processor adjusting timing of said traffic signals to most efficiently direct traffic through the intersection with respect to the number of vehicles that are approaching the intersection, each of said light detection and ranging sensor comprising:

a housing having a bottom side and a forward side, said bottom side being coupled to said upper end of a respective one of said mounting poles, said housing being oriented such that said forward side is directed toward an opposing traffic signal with respect to said traffic signal upon which said housing is mounted; and an emitter being integrated into said forward side wherein said emitter is configured to emit a laser beam across the intersection toward said opposing traffic signal, said emitter having a 20.0 percent vertical field of view, said emitter being electrically coupled to the remote data processor; and wherein said plurality of light detection and ranging sensors includes a set of front view light detection and ranging sensors and a set of rear view light detection and ranging sensors, each of said front view light detection and ranging sensors being positioned on said cross member of said respective traffic signal wherein each of said front view light detection and ranging sensors is configured to sense the front side of vehicles on the roadway, said emitter associated with each of said front view light detection and ranging sensors being oriented at a strategic downward angle thereby facilitating said emitter associated with each of said front view light detection and ranging sensors to scan traffic at said opposing traffic signal beginning from a cross walk aligned with said opposing traffic signal toward a direction of traffic flow of the vehicles approaching said opposing traffic signal wherein said emitter associated with each of said front view light detection and ranging sensors is configured to sense each vehicle that is stopped at said opposing traffic signal or each vehicle that is approaching said opposing traffic signal, each of said rear view light detection and ranging sensors being positioned on a stanchion being located adjacent to a respective roadway associated with the intersection, each of said rear view light detection and ranging sensors being positioned downstream from a respective one of said traffic signals with respect to the flow of traffic associated with said respective traffic signal, said emitter on each of said rear view light detection and ranging sensors being directed toward said respective traffic signal wherein each of said rear view light detection and ranging sensors is configured to sense the rear side of the vehicles on the roadway.

* * * * *